United States Patent [19]

Uchida et al.

[11] 4,371,252

[45] Feb. 1, 1983

[54] CONTACT TYPE CHARGING DEVICE WITH PLIABLE CONTACT MEMBER

[75] Inventors: Kohachi Uchida, Sagamihara; Yoshitsugu Nakatomi, Yokohama; Toshimasa Takano, Sagamihara; Hideo Mukai, Yokohama, all of Japan

[73] Assignee: Tokyo Shibaura Denki Kabushiki Kaisha, Kawasaki, Japan

[21] Appl. No.: 241,113

[22] Filed: Mar. 6, 1981

[30] Foreign Application Priority Data

Mar. 10, 1980 [JP] Japan ..... 55-30093
Apr. 18, 1980 [JP] Japan ..... 55-51242

[51] Int. Cl.[3] ..... G03G 15/02
[52] U.S. Cl. ..... 355/3 CH; 361/225
[58] Field of Search ..... 355/3 CH, 14 CH; 250/324–326; 361/225, 212, 214

[56] References Cited

U.S. PATENT DOCUMENTS 2,774,921 12/1956 Walkup ..... 361/225
3,146,385 8/1964 Carlson ..... 361/225
3,671,806 6/1972 Whitmore et al. ..... 355/3 CH

*Primary Examiner*—R. L. Moses
*Attorney, Agent, or Firm*—Cushman, Darby & Cushman

[57] ABSTRACT

A charging device includes a piled cloth contact which is formed of pliable material, has an electric resistance chosen to be $10^8$ Ω·cm and contacts a photosensitive layer of a photosensitive drum. An electrode is connected to the contact and has a lower electric resistance than that of the contact. A D.C. power source and A.C. power source supply D.C. and A.C. voltages on the electrode to charge the photosensitive layer.

17 Claims, 21 Drawing Figures

FIG. 15
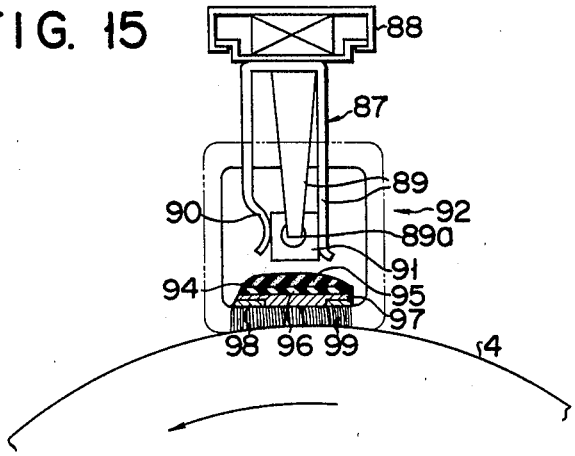
FIG. 16
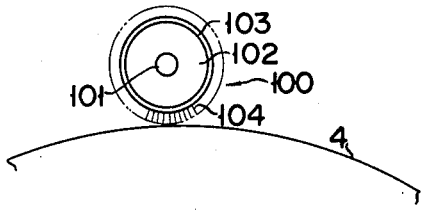
FIG. 17
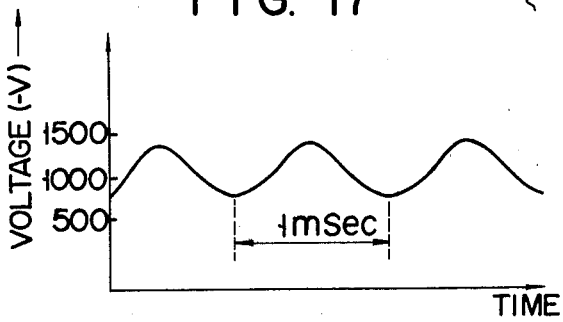
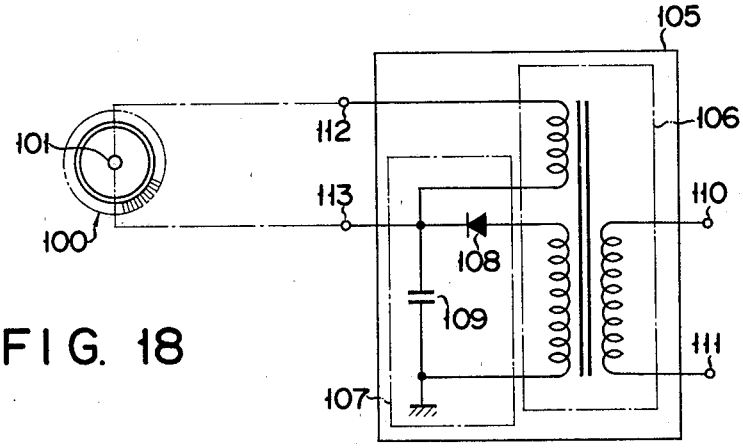
FIG. 18

CONTACT TYPE CHARGING DEVICE WITH PLIABLE CONTACT MEMBER

This invention relates to charging devices used with the electrostatic copiers, and more particularly to contact type charging devices.

Charging devices presently used with electrostatic copiers are mostly of the corona discharge type. However, the corona discharge type charging device is disadvantageous in that the high voltages involved may be dangerous to the operator, the atmosphere and the internal mechanisms of the electrostatic copier are contaminated by the generation of ozone and the corona discharge type charging device itself is expensive.

Prior to turning to corona devices, those skilled in the art had attempted to employ contact type charging devices which use a roller or brush for applying an electrostatic charge. However, contact type charging devices tend to damage mechanically or electrically the surface of a sensitized drum. To date, therefore, no contact charging device has been proposed which can continuously rub against a sensitized drum of an electrostatic copier without causing damage.

This invention has been accomplished in view of the aforementioned circumstances, and is intended to provide a charging device capable of uniformly charging the surface of a sensitized drum of an electrostatic copying apparatus with low voltage without damaging the surface mechanically or electrically and without generating ozone.

A charging device according to an aspect of the present invention includes: a pliable contact element having a prescribed electric resistance which contacts an object to be electrically charged. An electrode is electrically connected to the contact element and has a lower electric resistance than the electric resistance of the contact element. Voltage-impressing circuitry applies a voltage on the electrode to charge the object. The contact element includes a fiber base with fibers implanted thereon. A cushion may be positioned under the electrode. Also, the electrode and contact element may be in the form of an endless belt.

This invention can be more fully understood from the following detailed description when taken in conjunction with the accompanying drawings, in which:

FIG. 15 is a partial sectional view of a charging device according to a fifth embodiment of the invention;

FIG. 16 is a side view of a charging device according to a sixth embodiment of the invention;

FIG. 17 is a curve diagram showing the manner in which voltage is impressed on the charging device of FIG. 16;

FIG. 18 shows the arrangement of a circuit for generating voltage shown in FIG. 17;

Description is now given with reference to FIGS. 1 to 9 of the accompanying drawings a charging device according to a first embodiment of this invention.

Figure 1:
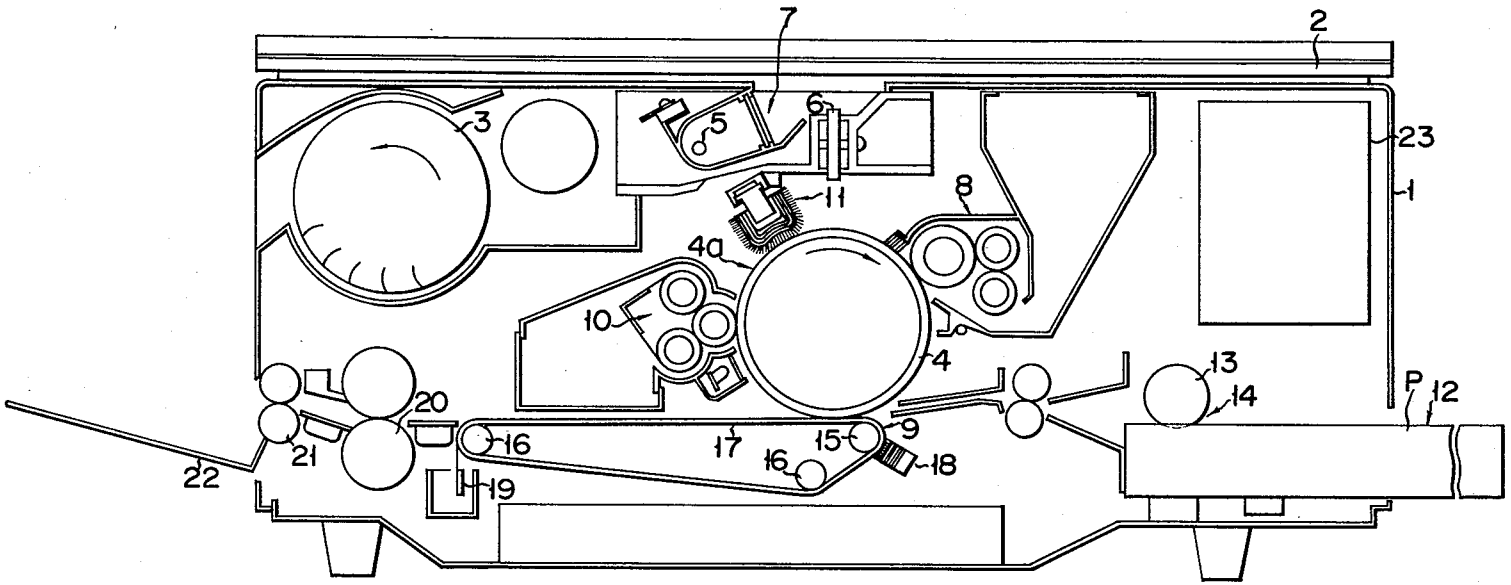
FIG. 1 is a schematic side view of an electrostatic copying apparatus provided with a charging device according to a first embodiment of this invention.

FIG. 1 shows the fundamental arrangement of an electrostatic copying apparatus. Reference numeral 1 denotes a housing of an electrostatic copying apparatus. An original sheet table 2 is mounted on the upper surface of the housing 1. This table 2 is reciprocated by a drive motor 3 set in the housing 1. A photosensitive drum 4*a* rotatable with the reciprocation of the original sheet table 2 is set substantially in the center of the housing 1. The photosensitive drum 4*a* comprises a cylindrical base body and a photosensitive layer 4 mounted around the outer peripheral wall of the cylindrical base body. The material for photosensitive layer 4 is prepared by dispersing synthetic resin in zinc oxide. A light-irradiating system 7, consisting of a lamp 5 and focusing light-transmitting element 6 is provided between the photosensitive layer 4 and original sheet table 2. The lamp 5 sheds a light on an original sheet placed on the original sheet table 2. The focusing light-transmitting element 6 conducts reflections therefrom to the photosensitive layer 4 to form a latent image of the original sheet on the photosensitive layer 4. A developer 8, transcription device 9, cleaning device 10 and the later described charging device 11 are arranged in the order mentioned from an image-forming position in clockwise direction around the photosensitive drum 4*a*. The developer 8 renders visible the latent image of the original sheet produced on the photosensitive layer 4 by the light-irradiating system 7 into a toner image. The transcription device 9 transposes the toner image of the original sheet formed on the photosensitive layer 4 onto a copy sheet P. The cleaning device 10 removes toner particles remaining on the surface of the photosensitive layer 4. Provided at the bottom of the housing 1 is a paper feeder 14 comprising a detachable cassette 12 holding a stack of copy sheets P and paper feed roller 13 for supplying a copy sheet P. The transcription device 9 comprises a drive roller 15, a plurality of driven rollers 16, and electrically insulated transcription belt 17 formed of, for example, polyethylene terephthalate film (manufactured by E. I. du Pont de Nemours & Co., Inc. of America with the trademark "Mylar") and stretched over the drive roller 15 and driven rollers 16. The transcription belt 17 contacts part of the outer peripheral wall of the photosensitive drum 4*a*. The transcription belt 17 is contacted by a transcription charging device 18 having the same arrangement as the aforementioned charging device 11 and cleaning blade 19. Disposed near the copy sheet delivery side of the transcription belt 17 are a fixing device 20 and delivery rollers 21. The fixing device 20 fixes the toner image of the original sheet transposed on the copy sheet P by the transcription device 9. The copy sheet whose impressed image has been fixed is drawn out on to a tray 22 by the delivery rollers 21. Reference numeral 23 denotes a control device.

The motor 3 is provided with an exhaust fan, which expels heat generated in the light-irradiating system 7 from the housing 1 by the rotation of the motor 3. The photosensitive drum 4*a* is constructed by coating the outer peripheral wall of a thin cylindrical aluminum base body having a thickness of 0.8 mm and a diameter of about 80 mm with the photosensitive layer 4. This photosensitive layer 4 is prepared by dispersing synthetic resin in zinc oxide and coagulating the mixed components by a binder. The mixture is further sensitized by adding a coloring matter such as Rose Bengal. The cleaning blade 19 cleans the surface of the transcription belt 17 by scraping toner particles remaining on the surface.

Figure 2:
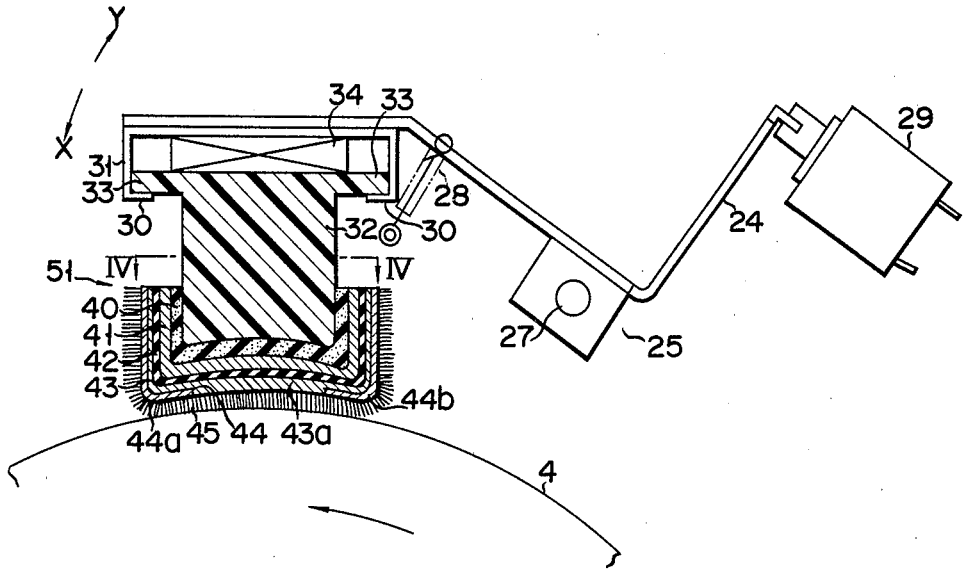
FIG. 2 is a cross sectional view of the charging device.
Figure 3:
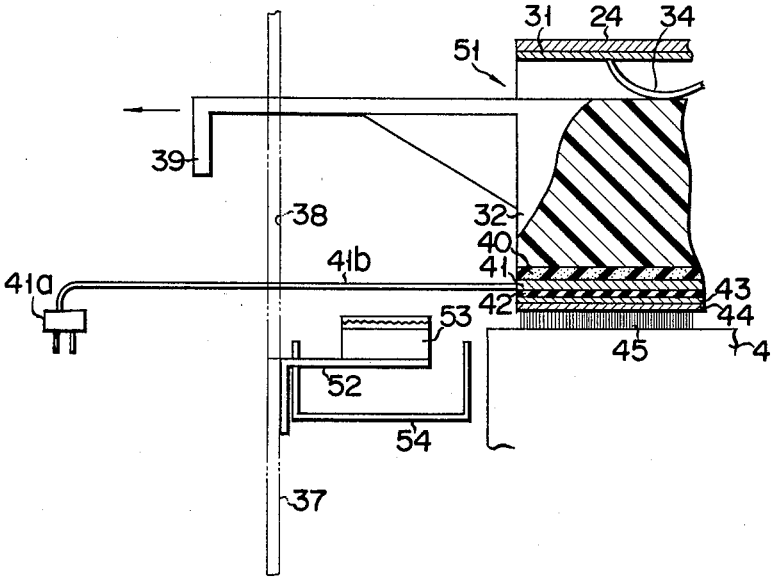
FIG. 3 is a longitudinal sectional view of the charging device as taken in a vertical direction.
Figure 4:
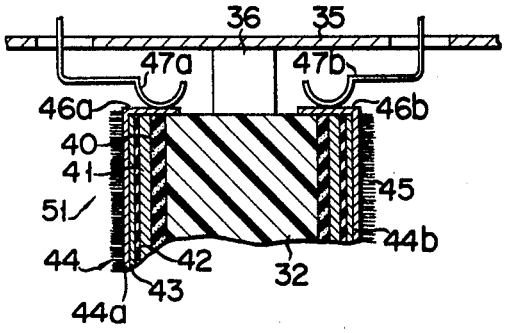
FIG. 4 is a longitudinal sectional view of the charging device as taken in a horizontal direction.
Figure 5:
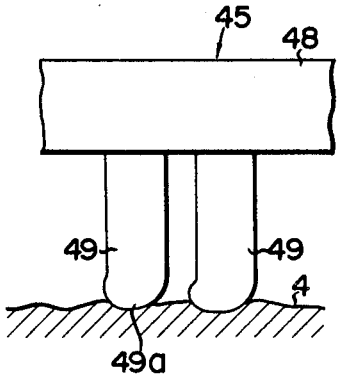
FIG. 5 is a side view of a piece of piled cloth contacting a photosensitive layer of a drum.

Description is now given with reference to FIGS. 2 and 3 of a charging device 11 according to a first embodiment of this invention. Reference numeral 24 denotes a bracket. This bracket 24 is rotatably supported on a frame 25 of the housing 1 by means of a pivotal shaft 27. The bracket 24 has its intermediate part held by the pivotal shaft 27 and can be rotated in a direction indicated by an arrow X or Y around the pivotal axis 27. One end of the bracket 24 is fitted with a tension spring 28 for urging the one end portion counterclockwise in a direction indicated by the arrow X. The other end of the bracket 24 is provided with a solenoid 29 for rotating the bracket 24 clockwise in a direction indicated by the arrow Y. In other words, the tension spring 28 causes the one end of the bracket 24 to be drawn near to the outer peripheral wall of the photosensitive layer 4. The solenoid 29 causes the one end of the bracket 24 to be pulled away from the outer peripheral wall of the photosensitive layer 4. That portion of the one end of the bracket 24 which faces the photosensitive layer 4 is provided with a guide frame 31 comprising a pair of rectangularly bent portions and extending in a direction perpendicular to the drawing. A base member 32 of a charging device 51 is detachably fitted to the guide frame 31. The base member 32 is prepared from acrylic or ABS (acrylonitrile-butadiene-styrene) resin in the form of an angular pillar extending in a direction perpendicular to the drawing. An integral engaging flange 33 is provided on the upper side of the base member 32 to be slidably engaged with both bent portions 30 of the guide frame 31. A press plate sprlng 34 is provided between the upper side of the base member 32 and the underside of the guide frame 31. The plate spring 34 urges the engaging flange 33 for contact with the guide frame 31. As a result, the base member 32 is elastically pressed against the guide frame 31. One lengthwise end portion of the base member 32 is pressed, as shown in FIG. 4, against a stopper 36 projectively formed on a rear frame 35 provided on the backside of the housing 1, thereby defining the lengthwise position of the photosensitive drum 4*a*. The other lengthwise end portion of the base member 32 faces a hole 38 (FIG. 3) which is formed in a front frame 37 provided on the front side of the housing 1 to allow for the detachable passage of the charging device. The side wall of the other end of the base member 32 which faces the hole 38 is provided with a projecting handle 39 for pulling out the charging device.

The lower portion of the base member 32 facing the outer peripheral wall of the photosensitive layer 4 comprises a cushion member 40, heater 41, insulating member 42, electrode 43, conductor 44, and piled cloth 45 acting as a contact member laminated in the order mentioned from the surface of the lower portion. As seen from FIGS. 2 and 3, the laminate surrounds the underside and both lateral sides of the base member 32 to form a charging body 51. The cushion member 40 is formed of a foamed synthetic resin sheet having a thickness of about 3 mm to concurrently act as an electrically insulating member. The heater 41 is intended to constantly heat the outermost contact cloth 45 in order to prevent it from being soaked with moisture, and is supplied with low power of several watts. The heater 41 is connected to a lead 41*b*, whose outer end is fitted with a connector 41*a*, and which is drawn out through the aforesaid hole 38 allowing for the detachable passage of the charging device. The insulating member 42 is prepared from polyethylene terephthalate film (manufactured by du Pont with the trademark "Mylar") with a thickness of about 25 microns. The electrode 43 is formed of a conductive rubber sheet having a thickness of about 50 microns. This rubber sheet is prepared by blending a first solution consisting of a solid component obtained by mixing 30% by weight of carbon (manufactured by CABOT Co. with the trademark "VULCAN XC72"), 50% by weight of SBR rubber (manufactured by ASAHI KASEI KOGYO K.K. with the trademark "TUFPRENE") and 20% by weight of xylene resin (manufactured by MITSUBISHI GAS KAGAKU K.K. with the trademark "NIKANOL") and a solvent with a second solution consisting of 50% by weight of the above-mentioned SBR rubber and 50% by weight of a solvent such as toluene in the ratio of 1:1. The electrode 43 is chosen to have a specific resistance of $10^5$ to $10^7$ Ω·cm lower than that of the contact cloth 45. The conductor 44 consists of two separate portions extending crosswise of the base member 32, that is, a D.C. aluminum conductor plate 44*a* and A.C. aluminum conductor plate 44*b* both having a thickness of about 50 microns. The D.C. aluminum conductor plate 44*a* and A.C. aluminum conductor plate 44*b* are separated from each other by a ridge-shaped charging member 43*a* extending along the lengthwise center line of the electrode 43. As shown in FIG. 4, those portions of the D.C. aluminum conductor plate 44*a* and A.C. aluminum conductor plate 44*b* which face the rear frame 35 are bent along the end face of the base member 32. These bent portions act as contact elements 46*a*, 46*b*. Those portions of the rear frame 35 which face the contact elements 46*a*, 46*b* are respectively fitted with a D.C. power supply blade 47*a* and an A.C. power supply blade 47*b*, which are connected to the contact elements 46*a*, 46*b*. With the first embodiment of this invention, the contact cloth 45 is formed of velveteen. This velveteen is formed by planting a large number of, for example, rayon fibers 49 on a cotton fiber base member 48.

The rayon fibers 49 have a thickness of 1.5 to 10 deniers and a length of 0.5 to 3 mm. The contact cloth 45 has a specific resistance generally ranging between $10^2$ and $10^{10}$ Ω·cm. With the first embodiment, the specific resistance is chosen to be $10^8$ Ω·cm. The backside of the cotton fiber base 48 of the contact cloth fabricated as described above is tightly attached to the aforementioned conductor 44 by means of a conductive adhesive 50. Referring to FIG. 3, a cleaning pad 53 (manufactured with a trademark "Etiquette Brush") is fixed to the inner wall of the front frame 37 disposed near the aforementioned hole 38 allowing for the detachable passage of the charging device by means of a support 52. A toner receptacle 54 is set below the cleaning pad 53. Where the charging body 51 is pulled out by means of the handle 39, then toner particles attached to the pile of the contact cloth 45 are scraped off by the cleaning pad 53 into the receptacle 54.

Figure 6:
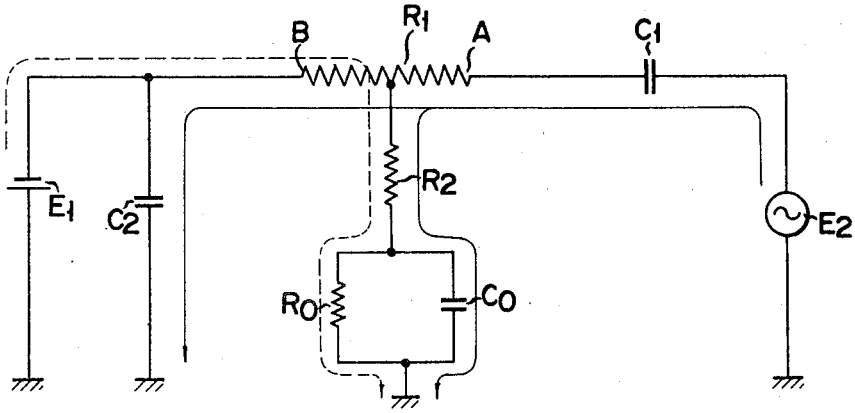
FIG. 6 is an electrically equivalent circuit diagram of the charging device of the invention and photosensitive drum.

Description is now given with reference to FIG. 6 of the electric operation of an arrangement of FIG. 2 constituted by the subject charging device and photosensitive drum. FIG. 6 shows an equivalent circuit of the arrangement. Reference numeral $R_1$ of FIG. 6 denotes the aforesaid electrode 43 equivalently taken as a resistor. $R_2$ represents the fibers 49 of the contact cloth 45 also equivalently taken is as a resistor. $E_1$ is a D.C. power source of, for example, 1 kV for generating a D.C. field. $E_2$ is an A.C. power source of, for example, 1 kV for generating an A.C. field. $C_1$ is a capacitor of, for example, 0.03 microfarad for obstructing the flow of direct current. $C_2$ is a capacitor of, for example, 0.03 microfarad for bypassing alternating current. A parallel circuit consisting of a resistor $R_0$ and a capacitor $C_0$ is an equivalent circuit of a photosensitive layer.

Where the power source $E_1$ supplies an electric field to one side of the electrode 43, and the power source $E_2$ supplies an electric field to the other side of the electrode at the same time, then current runs in the directions of arrows shown in FIG. 6. Alternating current runs in a direction indicated by a solid line, and direct current flows in a direction indicated by a broken line.

Figure 7:
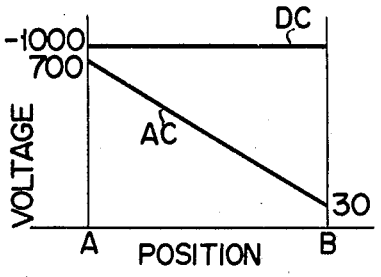
FIG. 7 is a curve diagram showing the manner in which alternating and direct currents are supplied to the electrode of the subject charging device.

Referring to FIG. 7, A denotes that end portion of the electrode 43 which is first contacted by a prescribed portion of the photosensitive layer 4 when it is rotated clockwise. B represents that end portion of the electrode 43 from which the prescribed portion of the clockwise rotated photosensitive layer 4 departs. Since the capacitor $C_2$ may be equivalently taken as a resistor with respect to alternating current, a potential resulting from the alternating current indicates a gradient progressively falling from point A to point B. On the other hand, a potential resulting from direct current shows no gradient.

Where an electric field is impressed on the electrode 43, then a capacitor equivalently formed in the photosensitive layer 4 is charged, thereby setting the photosensitive layer 4 in a charged state.

Description is now given of the operation of an electrostatic copying apparatus provided with a charging device embodying this invention. Where an original sheet placed on the original sheet table 2 is copied, a copy-starting button is first depressed. Then the respective mechanisms of the copying apparatus carry out the prescribed operation, causing the original sheet to be copied. A transferred copy sheet P has its image fixed, and then is drawn out onto the tray 22. In the copying mode, a prescribed level of voltage is impressed from the power supply device on the electrode 43 of the charging device 11 when the photosensitive drum **4*a* is rotated. The electrode 43 contacted by the D.C. conductor plate 44*a* and A.C. conductor plate 44*b* is impressed with voltage formed of A.C. superposed on D.C. In this case, D.C. is chosen to have 1,000 volts, and A.C. is chosen similarly to have 1,000 volts. Where the A.C. and D.C. are superposed on each other, then a bulk charge of the photosensitive layer 4 containing zinc oxide is accelerated, causing the photosensitive layer 4 to be uniformly sensitized in a short time. Where D.C. alone is impressed on a photosensitive layer 4 which particularly contains zinc oxide, experiments indicate that the photosensitive layer 4 achieves an unstable sensitized state, causing electric energy in the photosensitive layer 4** to be noticeably attenuated.

The reason for the occurrence of this drawback is assumed to be that the photosensitive layer 4 can be equivalently taken to have a static capacity $C_1$. When microscopically observed, the ZnO particles included in the photosensitive layer 4 equivalently contain a static capacity $C_2$. When the photosensitive layer 4 is sensitized, the static capacity $C_2$ is first charged. This event supposedly causes the capacity $C_1$ to be charged. In other words, a bulk charge is effected. When the capacity $C_2$ is charged, the A.C. field is noticeably effective.

The above-mentioned event is prominently observed in a ZnO-containing photosensitive layer used in the first embodiment of this invention which is further sensitized by a certain coloring matter.

Figure 8:
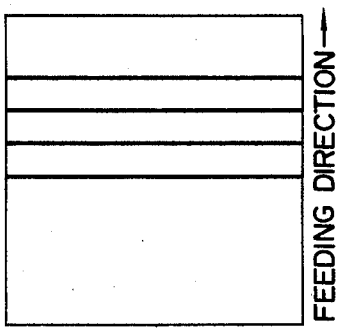
FIG. 8 is a plan view showing irregularities appearing in an image impressed on a copy sheet.
Figure 9:
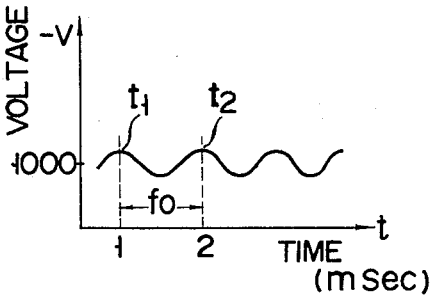
FIG. 9 is a curve diagram indicating the manner in which an alternating current is supplied to the electrode of the subject charging device.
Figure 10:
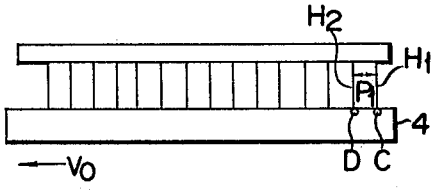
FIG. 10 is a side view of a piece of piled cloth contacting the photosensitive layer of the drum.

The following characters denote factors related to the charged condition of the photosensitive layer 4:

$V_0$: circumferential speed of the rotating photosensitive drum $V_1$: circumferential speed of the rotating developing roller $f_0$: frequency with which an electric field is repeatedly applied to the charging device $\alpha$: a constant of the charging device defined, for example, by the pitch $P_1$ at which the fibers of the contact cloth are planted Where an A.C. field alone is applied to the charging device, then dark and light irregularities as shown in FIG. 8 appear on an image at a certain pitch, depending on the values of the above listed factors, where a wholly black original sheet is copied.

Where an A.C. field illustrated in FIG. 9 is applied to a charging device in which a piled contact cloth is attached to a photosensitive layer 4 as shown in FIG. 10, then the above-mentioned undesirable event is assumed to take place for the following reason. Now let it be assumed that a certain portion of the photosensitive layer 4 is shifted from point C at which the portion touches the tip of fiber $H_1$ of a contact cloth to point D at which the portion touches the tip of another adjacent fiber $H_2$. Further, let it be supposed that a certain electric field is applied to a fiber $H_1$ at a point of time $t_1$. Then the fiber $H_1$ is set at a negatively charged state, causing that portion of the photosensitive layer 4 to be negatively charged. If, in case the above-mentioned portion of the photosensitive layer 4 is shifted point C to point D, a point of time $t_2$ is reached at which the same electric field is applied as at the point of time $t_1$, then the portion of the photosensitive layer 4 which corresponds to point D is again negatively charged. Thus, irregularities appear at a certain pitch on the charged surface of the photosensitive layer. If, under such irregularly charged condition, toner particles settle, for example, on a highly charged portion of the photosensitive layer 4 (this event arises depending on the value of $v_1$), then that portion of an image which corresponds to such highly charged portion of the photosensitive layer 4 is prominently blackened.

The present inventors made experiments with the above-mentioned event and discovered that the following relationship resulted concerning the pitch of the fibers of the contact cloth which gave rise to dark and bright irregularities on an image as illustrated in FIG. 8.

$$f(v_0, v_1, f_0) = \alpha v_0, v_1/f_0$$

Where, therefore, $f_0$ is chosen to have a large value as 0.5 to 1 KHz, then the aforementioned dark and bright irregularities appearing on an image can be reduced to an extent substantially indistinguishable by the naked eye with respect to the originally applied factors $v_0$, $v_1$. The above-defined factor f means a pitch of stripes. The smaller the value of the term $f_0$ given in the above-mentioned equation, the higher the circumferential speed of the photosensitive drum, and the larger the pitch $P_1$ of the fibers of the contact cloth, then the more extended the pitch of stripes.

A charging device according to a first embodiment of this invention very stably produces a surface potential as experimentally proved. In other words, substantially no change appeared in the surface potential of the photosensitive layer 4 when a photosensitive drum long stored in a dark place was put into operation, or a photosensitive drum was continuously run for long hours, or a light was intermittently irradiated on the photosensitive layer of the drum. The charging device according to the first embodiment had further merit that the surface potential of the photosensitive layer little changed with the environmental conditions such as ambient temperature and humidity. Obvious, it is necessary to plant the fibers of a contact cloth with a sufficiently great density and provide such a mechanical arrangement as enables the whole of the subject charging device to be pressed against the photosensitive layer 4 of the drum uniformly and softly.

Needless to say, numerals related to the aforementioned embodiment are given simply by way of illustration. Of course, the materials of the embodiment are adopted merely to realize the fundamental concept of this invention. Obviously, the invention is not limited to the embodiment. For example, the electrode 43 may be formed of a paper sheet containing carbon, conductive rubber or any other material. The rayon velveteen may be easily replaced by any other cloth, or by a brush whose fibers are statically planted, or even a foamed plastics material.

Experiments prove that with an electrostatic copying apparatus provided with a drum coated with a photosensitive layer containing zinc oxide, over 10,000 times of charge and discharge cycles did not give rise to the mechanical and electric damage of the photosensitive layer by the charging device of this invention, achieving far better results than the corona discharge type charging device. Such advantages are supposed to result from the following facts:

(1) The power source of the charging device of this invention has a far lower voltage than in the corona discharge type charging device, subjecting the electrostatic copying apparatus to greatly reduced electric shocks.

(2) No ion bombardment takes place.

(3) With the ZnO-containing photosensitive layer. great difficulties arose due to the deterioration of the electrostatic copying apparatus by generation of ozone. In contrast, the charging device of the invention is completely free from such drawbacks, achieving prominently improved results.

The above-listed advantages greatly contribute to a decrease in the deterioration of the property of a photosensitive layer. Obviously, no limitation is imposed on the material of a photosensitive layer. With the present charging device, a power source has a low voltage, and a small current well serves the purpose, noticeably reducing wattage. These facts, together with the simple arrangement of the present charging device, prominently help to decrease the cost of an electrostatic copying apparatus.

Figure 11:
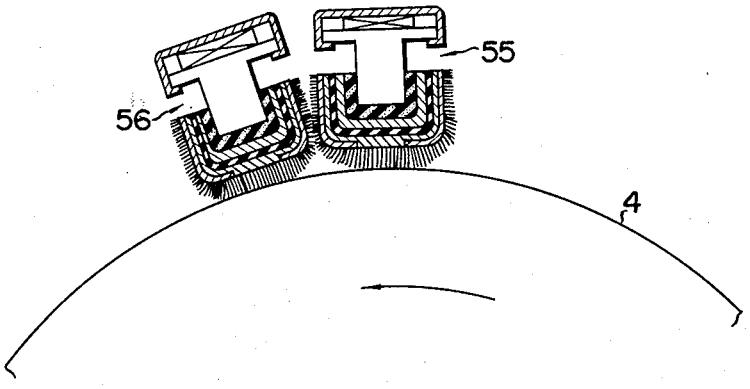
FIG. 11 is a side view of a charging device according to a second embodiment of the invention.

Description is now given with reference to FIG. 11 of a charging device according to a second embodiment of this invention. With the first embodiment, the charging device 51 was provided with a single electrode 43, which was simultaneously impressed with A.C. and D.C. voltages. With the second embodiment, a first charging device 55 and a second charging device 56 are juxtaposed in the circumferential direction of the photosensitive drum 4*a* in a state facing the peripheral wall thereof. A.C. voltage is impressed on the first charging device 55, and D.C. voltage is supplied to the second charging device 56.

Figure 12:
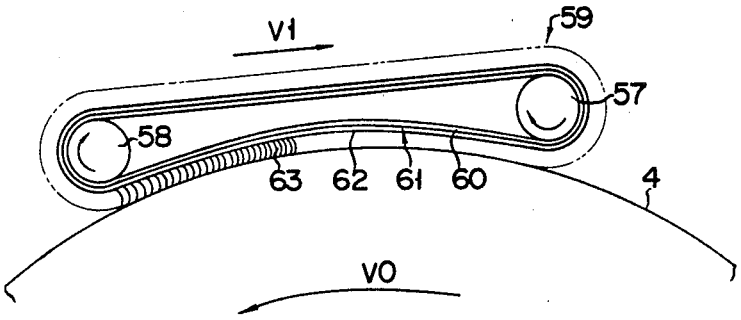
FIG. 12 is a side view of a charging device according to a third embodiment of the invention.

Description is now given with reference to FIG. 12 of a charging device according to a third embodiment of the invention. With the first and second embodiments, the contact cloth 45 of the charging device was provided in a stationary state. With this third embodiment, however, the contact cloth 45 is made movable. Referring to FIG. 12, reference numeral 57 denotes an A.C. conduction roller, and reference numeral 58 represents a D.C. conduction roller. These rollers 57, 58 are formed of aluminum and spatially set in parallel in the circumferential direction of the photosensitive drum 4*a* in the proximity of the peripheral wall of the photosensitive layer 4. The A.C. conduction roller 57 is connected to a drive motor (not shown). A charging belt 59 is stretched across the A.C. conduction roller 57 and D.C. conduction roller 58, to contact the photosensitive drum 4*a* while running in the same direction as the photosensitive drum 4*a*. The charging belt 59 is constructed by superposing a cloth belt 61, for example, by an adhesive on the outer wall of an electrode belt 60 prepared from the same conductive rubber as that of the first embodiment. The cloth belt 61 is constituted, as in the first embodiment, by a velveteen sheet formed of a fiber base 62 and fibers 63. The cloth belt 61 is chosen to have a resistance of $10^8$ Ω·cm. The relationship between the running speed $v_1$ of the charging belt 59 and the peripheral speed $v_0$ of the photosensitive drum 4*a* is set at $v_1/v_0 = 1.5$, thereby extending a length of time for which the fibers 63 contact the unit area of the photosensitive layer 4.

Figure 13:
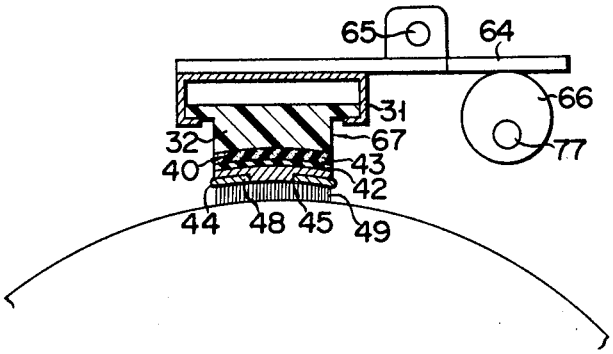
FIG. 13 is a side view of a charging device according to a fourth embodiment of the invention.
Figure 14:
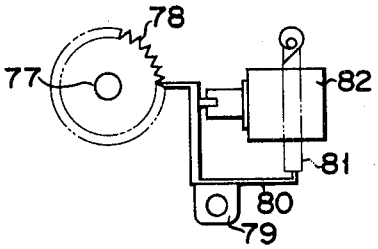
FIG. 14 is a side view of the drive mechanism of the charging device of FIG. 13.

Description is now given with reference to FIGS. 13 and 14 of a charging device according to a fourth embodiment of this invention. With this fourth embodiment, the pressure with which the fibers contact the photosensitive layer 4 is made to vary with the humidity of the fibers, thereby ensuring a constant charged state. Referring to FIG. 13, reference numeral 64 denotes a bracket whose intermediate portion is rotatably held by a pivotal shaft 65. The bracket 65 is contacted at one end by a cam 66 and at the other end fitted with a charging device.

The cam 66 is provided with an eccentric shaft 77. This cam shaft 77 comprises a ratchet 78 (FIG. 14) fitted with a spring clutch. The ratchet 78 is detachably engaged with the end portion of a stop lever 80 rotatable about a pivotal pin 79. The rear end of the stop lever 80 is fitted with a spring 81 for urging the stop lever 80 for engagement with the ratchet 78. The front end of the stop lever 80 is connected to a solenoid 82 which pulls the front end from the ratchet 78 against the urging force of the spring 81. The stop lever 80 is engaged with or disengaged from the ratchet 78 in accordance with an electric signal supplied to the solenoid 82. Where the stop lever 80 is released from the ratchet 78, then the cam 66 is rotated about the cam shaft 77 by the urging force of the spring clutch. Where the cam 66 is rotated, then the bracket 64 is rotated about the pivotal shaft 65, thereby varying the pressure with which the contact cloth 74 of the charging device 67 is pressured against the photosensitive layer 4. Where the contact cloth 74 is more moistened, then its resistance falls, enabling a larger current to be conducted to the photosensitive layer 4. As a result, the cloth 74 is pressed against the photosensitive layer 4 with an increased mutual frictional force. Thus, the cloth 74 gets drier to fall in humidity.

Description is now given with reference to FIG. 15 of a polygonal charging device according to a fifth embodiment. Reference numeral 87 denotes a support mechanism detachably fitted to a guide frame 88. The support mechanism 87 comprises a support member 89 having a pivotal shaft 89*a* and a press member 90 consisting of a plate spring. A charging device 92 is rotatably supported by the pivotal shaft 89*a*, and comprises a charging base 91 formed of an angular member and rotatably and elastically clamped between the support member 89 and press member 90, and a laminated mass which is mounted on the outer peripheral wall of the charging base 91 and consists of a cushion member 94, heater 95, insulation member 96, electrode 97 prepared from electrically conductive rubber, conductor 98 and velveteen cloth 99 in the order mentioned from the charging base 91. The charging device 92 constructed as described above is made rotatable about the pivotal shaft 89*a*. Where, therefore, a certain portion of the velveteen cloth 99 is worn out, a different portion thereof can be made to contact the photosensitive layer 4 by properly rotating the charging device 92. If, in this case, the charging device 92 is made into a polygonal form such as a pentagon or hexagon, then the charging device 92 can have its life prominently extended.

Description is now given with reference to FIGS. 16 to 18 of roller type charging device according to a sixth embodiment of this invention. Reference numeral 100 represents a charging roller rotatably supported by a pivotal shaft 101. The charging roller 100 comprises an aluminum core 102, electrode 103 prepared from electrically conductive rubber wound abougt the roller core 102, and velveteen cloth 104 wound about the electrode 103. The charging roller 100 is rotated by a drive motor (not shown) in contact with the photosensitive layer 4. The charging roller 100 is connected to a power source 105 (FIG. 18) for impressing a potential illustrated in FIG. 17. The power source 105 is provided with an iron resonance transformer 106, and a rectifier 107 comprising diode 108 and capacitor 109. The primary winding of the iron resonance transformer 106 is connected to a pair of input terminals 110, 111. One secondary winding of the iron resonance transformer 106 is connected to a pair of output terminals 112, 113. Another secondary winding of the iron resonance transformer 106 is connected to the rectifier 107.

The output terminal of the rectifier 107 is connected to the output terminal 113 of the another secondary winding. Therefore, A.C. voltage impressed on the input terminals 110, 111 is transformed by the iron resonance transformer 106, and thereafter supplied to the output terminal 112 and rectifier 107. This rectifier 107 delivers transformed D.C. voltage to the output terminal 113 of the another secondary winding. The output terminal 112 of the one secondary winding is electrically connected to the charging roller 100. The waveform shown in FIG. 17 is a sine curve. Instead, the voltage impressed on the charging device of this invention may have a rectangular waveform.

Figure 19:
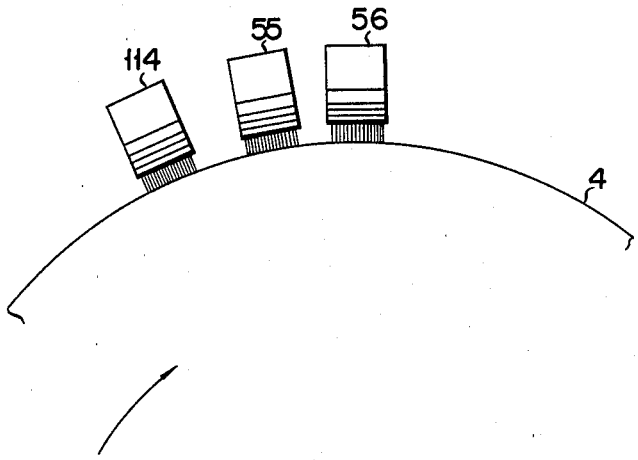
FIG. 19 is a side view of a charging device according to a seventh embodiment of the invention.

Description is now given with reference to FIG. 19 of a charging device according to a seventh embodiment of this invention. This seventh embodiment comprises the first and second charging devices 55, 56 as in the second embodiment and further another charging device 114 which has the same arrangement as the first and second charging devices 55, 56, but is used as a discharging unit. Where A.C. voltage is impressed on the discharging unit 114, then the photosensitive layer 4 is discharged.

Figure 20:
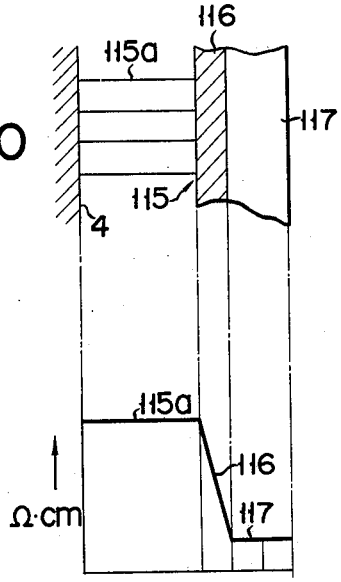
FIG. 20 is a side view of a charging device according to an eighth embodiment of the invention accompanied with a related graph.

Description is now given with reference to FIG. 20 of a charging device according to an eighth embodiment of this invention. With the first embodiment of the invention, the backside of the fiber base 48 of the contact cloth 45 is attached to the conductor 44 by applying an adhesive 50 to the backside. With the eighth embodiment, an aluminum conductor 117 is thermally deposited on the backside of a fiber base 116 of a contact cloth 115 comprising furs 115*a*. This arrangement causes the conductor 117 to be sharply reduced in resistance to the furs 115*a* as seen from the graph included in FIG. 20.

Figure 21:
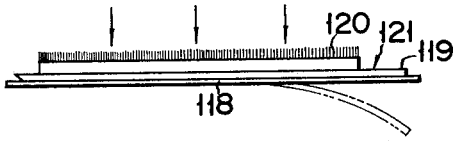
FIG. 21 is a side view of a charging device according to a ninth embodiment of the invention.

Description is now given with reference to FIG. 21 of a charging device according to a ninth embodiment of this invention. With this ninth embodiment, the contact cloth is attached to the electrode by a different process from what was applied in the foregoing embodiments. Namely, a releasing paper sheet 118 is coated with a mixture 119 formed of the first and second solutions used in the first embodiment. After the mixture is dried to a certain extent, a velveteen sheet 120 is mounted on the mixture. The surface of the velveteen sheet 120 is hot pressed to cause an electrode 121 prepared from conductive rubber to be attached to the backside of the velveteen sheet 120. Last, the releasing paper sheet 118 is removed. The above-mentioned attachment of the velveteen sheet 120 to the electrode 121 causes the mixed solution 119 to seep into the fiber base of the velveteen sheet 120, thereby saving the velveteen sheet 120 from changes with time in resistance.

The electrode and contact cloth constituting the charging device used in the aforementioned embodiments have the same composition as described with respect to the first embodiment, detailed reference being omitted.

The charging device of this invention is not restrictively applied to a photosensitive layer of an electrostatic copying apparatus, but may be used to charge dielectric element such as a polyester sheet.

A velveteen sheet was used in all the aforementioned embodiments. However, this invention is not limited to such arrangement. But the contact element may be formed of a short fiber sheet such as Etiquette Brush (trademark).

What we claim is:

1. A charging device comprising:
a base;
a cushioning layer formed on that portion of said base which faces an object to be charged;
an electrode attached to that side of said cushioning layer which faces said object to be charged;
a contact member connected to said electrode contacting said object to be charged, said contact member having a prescribed electrical resistance greater than the electrical resistance of said electrode, said contact member including a fiber base and a large number of fibers planted on said fiber base;
conductive adhesive for attaching said fiber base to said electrode; and
means for supplying voltage on said electrode to charge said object to be charged.

2. The charging device according to claim 1, further comprising means for allowing the base of said charging device to be movable from the object to be charged.

3. The charging device according to claim 2, wherein the voltage-supplying means comprises A.C. and D.C. power sources.

4. The charging device according to claim 3, which further comprises an A.C. conductor for connecting the A.C. power source to one part of the electrode, and a D.C. conductor for connecting the D.C. power source to the other part of the electrode.

5. The charging device according to claim 4, wherein the object to be charged is a photosensitive layer mounted on the surface of a rotatable drum; the D.C. conductor is connected to the forward end of the electrode as viewed from the rotating direction of the drum and the A.C. conductor is connected to the rear end of the electrode as viewed from the rotating direction of the drum.

6. The charging device according to claim 5, wherein the photosensitive layer mainly consists of zinc oxide.

7. The charging device according to claim 1, 2, 3, 4, 5 or 6, which further comprises means for removing moisture from the fibers of the contact cloth.

8. The charging device according to claim 7, wherein the moisture-removing means comprises:
a heating layer mounted on that side of the cushioning layer which faces the object to be charged;
an insulation layer interposed between the heating layer and electrode; and
a power source for supplying power to the heater to cause it to emit heat.

9. The charging device according to claim 7, wherein the moisture-removing means comprises:
a device for detecting the humidity of the fibers of the contact cloth; and
a mechanism for drawing the base of the charging device toward the object to be charged in accordance with the detected humidity of said fibers,
and when pressed against the object to be charged, the fibers generate heat by frictional engagement with said object to be charged.

10. The charging device according to claim 2, which further comprises:
a base of the other charging device; and
another cushioning layer, another electrode and another contact member mounted in the order mentioned on that side of the base of said other charging device which faces the object to be charged as counted from said side.

11. The charging device according to claim 10, wherein the voltage-supplying means comprises A.C. and D.C. power sources.

12. The charging device according to claim 11, which further comprises:
an A.C. conductor for connecting the A.C. power source to one electrode; and
a D.C. conductor for connecting the D.C. power source to the other electrode.

13. The charging device according to claim 1, wherein the base of the charging device is formed into a parallelepiped having a square cross section, and made rotatable about the central line of said square cross section; and the cushioning layer, electrode and contact member are extended along the respective peripheral planes centered by the pivotal shaft.

14. The charging device according to claim 1, wherein the base of the charging device is made into a cylindrical form and rotated about the pivotal shaft; and the cushioning layer, electrode and contact member are mounted on the peripheral wall of the base of the charging device in the order mentioned as counted from said peripheral wall.

15. A charging device comprising:
a contact member formed of a pliable material in an endless belt and having a prescribed electrical resistance, said contact member contacting an object to be charged;
an electrode connected to said contact member, said electrode being in the form of an endless belt and having a lower electrical resistance than said contact member;
a pair of rollers, said electrode and contact member endless belts being superposed on each other and jointly stretched across said pair of rollers;
means for rotating at least one of said paired rollers; and
means for supplying voltage on said electrode to charge said object to be charged.

16. A charging device according to claim 15, wherein said contact member comprises a fiber base and a large number of fibers planted thereon.

17. The charging device according to claim 15, wherein the voltage-supplying means comprises A.C. and D.C. power sources; the paired rollers are formed of conductive material alike; one of said paired rollers is connected to the A.C. power source; and the other of said paired rollers is connected to the D.C. power source.

* * * * *